US005992545A

United States Patent [19]

Ekwall

[11] Patent Number: 5,992,545

[45] Date of Patent: Nov. 30, 1999

[54] DOWN-THE-HOLE DRILLING MACHINE

[75] Inventor: Berndt Ekwall, Saltsjöbaden, Sweden

[73] Assignee: Uniroc AB, Fagersta, Sweden

[21] Appl. No.: 09/081,859

[22] Filed: May 19, 1998

[30] Foreign Application Priority Data

Jul. 2, 1997 [SE] Sweden ..... 9702547

[51] Int. Cl.[6] ..... E21B 4/14

[52] U.S. Cl. ..... 175/296; 173/136

[58] Field of Search ..... 175/296, 92, 215; 173/137, 210, 91, 136, 100

[56] References Cited

U.S. PATENT DOCUMENTS

| | | | |
|---|---|---|---|
| 3,198,264 | 8/1965 | Oelke et al. . | |
| 3,524,511 | 8/1970 | Klemm | 175/92 |
| 3,991,834 | 11/1976 | Curington | 173/73 |
| 4,321,974 | 3/1982 | Klemm | 175/92 |
| 4,932,483 | 6/1990 | Rear | 175/296 |
| 5,139,096 | 8/1992 | Lister | 175/92 |
| 5,238,073 | 8/1993 | Rear | 175/53 |
| 5,685,380 | 11/1997 | Purcell et al. | 175/215 |

*Primary Examiner*—Frank Tsay
*Attorney, Agent, or Firm*—Mark P. Stone

[57] ABSTRACT

Down-the-hole drilling machine comprising a housing (1) with a hammer piston (5) movable to-and-fro and intended to exert a drill bit (3) to impacts. The hammer piston is formed with two piston heads (6,7) and a waist (9) between them. An intermediate wall (10) is arranged around the waist (9) so that two chambers (11,12) are formed on either side of the intermediate wall. The chamber (11) between the intermediate wall and the forward piston head (6) is continuously pressurized via a first channel (13) in the intermediate wall. The chamber (12) is via a second channel (15) in the intermediate wall connected to a space (16) in front of the hammer piston (5). Through this double drive areas are obtained during the working stroke of the hammer piston.

1 Claim, 1 Drawing Sheet

DOWN-THE-HOLE DRILLING MACHINE

BACKGROUND OF THE INVENTION

The present invention relates to a down-the-hole drilling machine of the kind which comprises two drive areas for the working stroke of the hammer piston.

SUMMARY OF THE INVENTION

In a previously known down-the-hole drilling machine of the above mentioned kind, see U.S. Pat. No. 3,198,264, double drive areas are used both for the working stroke and for the return stroke. This design has the drawback that a number of channels are needed in the housing around the hammer piston for supply of air to and disposal of air from the different chambers. These channels must be at a certain distance from each other in order to obtain adequate sealing between the channels. This creates a relatively strong throttling of the air flows in the machine. Since the air volumes adjacent to all four drive areas are alternately pressurized and unloaded a relatively high air consumption is obtained. This means that the down-the-hole drilling machine gets lower performance and higher air consumption.

The present invention, which is defined in the subsequent claim, aims at achieving a down-the-hole drilling machine where high impact energy is obtained by means of double drive areas without limitation of performance through strong throttling. Furthermore, lower air consumption is obtained because one does not alternately pressurize and unload all the volumes adjacent to the drive areas.

BRIEF DESCRIPTION OF THE DRAWINGS

An embodiment of the invention is described below with reference to the accompanying drawing in which.

DESCRIPTION OF THE BEST MODES FOR CARRYING OUT THE INVENTION

Figure 1:
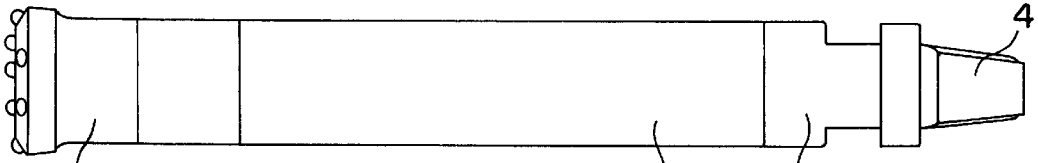
FIG. 1 shows a side view of a down-the-hole drilling machine.
Figure 2:
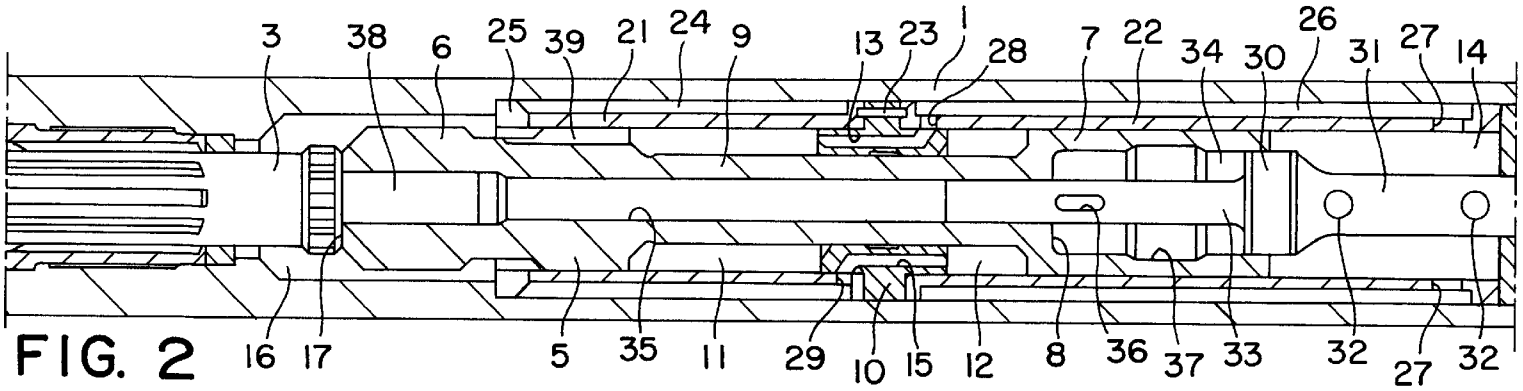
FIG. 2 shows a section through a part of the down-the-hole drilling machine according to FIG. 1 with the hammer piston in impact positiion.
Figure 3:
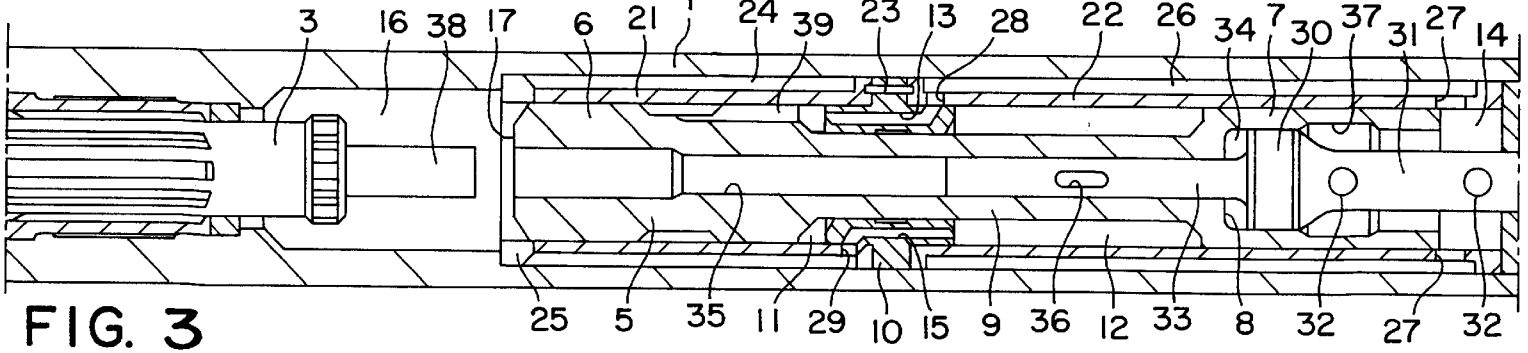
FIG. 3 shows a section through a part of the down-the-hole drilling machine according to FIG. 1 with the hammer piston in a rear turning position.

The down-the-hole drilling machine shown in the drawing comprises a housing 1 comprising an impact device. At the front end of housing 1 a drill bit 3 is arranged for cooperation with the hammer device in the usual way. At the rear end of housing 1 a rear piece 2 is arranged. The rear piece 2 is provided with a thread 4 for connection to a not shown tube string in the usual way. The tube string conducts driving medium to the hammer device and transfers rotation to the down-the-hole drilling machine. Housing 1 comprises a front lining 21 and a rear lining 22. A hammer piston 5 movable to-and-fro is journalled in the linings 21, 22. The hammer piston is provided with a forward piston head 6 and a rearward piston head 7. Between the piston heads the hammer piston is provided with a waist 9. An intermediate wall 10 is fixed between the linings. The intermediate wall 10 surrounds the waist 9 and is suitably divided lengthwise for mounting purposes. A pin 23 is arranged through the intermediate wall 10 in order to lock the linings 21,22 in fixed angular positions relative to the intermediate wall. Between the front lining 21 and the outer part of the housing 1 there is a channel 24 which extends around the front lining 21. The front lining 21 is at the forward end provided with a number of thin supports 25 for centering of the front lining 21. Between the rear lining 22 and the outer part of housing 1 there is a channel 26 which extends around the rear lining 22. The rear lining is at its rear end provided with a number of radial holes 27 which connect channel 26 with a room 14 which functions as a pressure source for the down-the-hole drilling machine. The intermediate wall 10 comprises a first channel 13 which together with holes 28 in the rear lining 22 continuously connect a first chamber 11 with channel 26. The first chamber 11 is thus in operation continuously pressurized. The intermediate wall 10 also comprises a second channel 15 which together with holes 29 in the front lining connects a second chamber 12 with channel 24. Channel 24 is connected with a space 16 in front of the front end 17 of the hammer piston 5. The pressure in the second chamber 12 is thus essentially the same as in space 16. The down-the-hole drilling machine comprises a valve part 30 for cooperation with hammer piston 5. Valve part 30 is arranged on a tube 31 fixed in the down-the-hole drilling machine. Driving medium is supplied from the connected tube string, not shown, via tube 31 and holes 32 through the tube to room 14. A tube 33 is connected with valve part 30 and extends into a central channel 35 in hammer piston 5. Hammer piston 5 and valve part 30 form between them a room 34. Hammer piston 5 has in room 34 a drive area 8 for the working stroke of the hammer piston. Tube 33 is provided with radial holes 36. The rear part of hammer piston 5 is provided with a turned down part 37. Driving medium can pass between hammer pison 5 and valve part 30 when valve part 30 passes the turned down part 37. In the positions of hammer piston 5 shown in FIGS. 2 and 3, the hammer piston and the valve cooperate sealingly. Hammer piston 5 is provided with a number of grooves 39 which with the hammer piston in the FIG. 2 position connect first chamber 11 with space 16. Drill bit 3 is provided with a tube 38 which is connected to the flushing channel, not shown, of drill bit 3. Tube 38 forms together with hammer piston 5 a foot valve.

The shown down-the-hole drilling machine works in the following way. In the position shown in FIG. 2 hammer piston 5 has just delivered an impact to drill bit 3. In this position the pressure in room 34 is lowered because flushing medium is conducted through hole 36, central channel 35, tube 33 and the flushing channel, not shown, of drill bit 3. Furthermore second chamber 12 is pressurized from first chamber 11 via grooves 39 in hammer piston 5, space 16, channel 24, hole 29 second channel 15. In this position hammer piston 5 is driven backwards, to the right in FIG. 2, by the pressure against front end 17 of hammer piston 5. When the turned down part 37 of hammer piston 5 passes valve part 30 driving medium is supplied to room 34. This driving medium is after that enclosed in room 34. When tube 38 leaves central channel 35 the pressure in space 16 is decreased through the flushing channel of drill bit 3. Through this also the pressure in second chamber 12 is decreased through second channel 15, holes 29 and channel 24. As a result of these pressure changes hammer piston 5 turns in the position shown in FIG. 3. In this position the working stroke of hammer piston 5 starts because increased pressure is present in room 34, with drive area 8, and in first chamber 11 which is continuously pressurized from pressure source 14 via radial holes 27, channel 26, holes 28 and first channel 13 at the same time as lower pressure is present in space 16 and in second chamber 12. Further driving medium is supplied to room 34 when the turned down part 37 of hammer piston 5 passes valve part 30. During the working stroke of hammer piston 5 both room 34 and first chamber 11 are thus pressurized for driving hammer piston 5 toward drill bit 3. During the return stroke the pressure in first chamber 11 is balanced by the pressure in second chamber 12.

I claim:

1. Down-the-hole drilling machine comprising a housing (1), a rear piece (2) arranged at a rear end of the housing, a drill bit (3) arranged at a front end of the housing, a hammer piston (5) movable to-and-fro in the housing for impacting against said drill bit, said hammer piston comprising a forward piston head (6) and a rearward piston head (7) provided with a drive area (8) for the working stroke of the hammer piston and a waist (9) arranged between the piston heads, a first chamber (11) arranged between said forward piston head (6) and an intermediate wall (10), and a second chamber (12) arranged between said rearward piston head (7) and said intermediate wall (10), said first and second chambers being separated by said intermediate wall, characterized in that said intermediate wall (10) comprises a first channel (13) which continuously connects said first chamber (11) with a pressure source (14) and a second channel (15) which connects said second chamber (12) with a space (16) in front of a front end (17) of the hammer piston (5).

* * * * *